United States Patent [19]

Bartik

[11] 3,974,940

[45] Aug. 17, 1976

[54] METHOD AND APPARATUS FOR CONTROLLING THE DISCHARGE OF CONTAMINANTS FROM SHIPS

[76] Inventor: Ivan Bartik, 727 Timber Lane, Cookeville, Tenn. 38501

[22] Filed: Feb. 24, 1975

[21] Appl. No.: 552,130

[52] U.S. Cl. ..... 222/52; 222/71; 222/176; 222/1; 235/151.35; 114/.5 R

[51] Int. Cl.[2] ..... B63B 35/00

[58] Field of Search ..... 114/.5 R, 232, 234, 114/67; 222/1, 52, 59, 71, 76, 176; 235/151.35, 151.34; 137/487.5

[56] References Cited

UNITED STATES PATENTS

| | | | |
|---|---|---|---|
| 387,324 | 8/1888 | Stebbins | 114/232 |
| 1,575,134 | 3/1926 | Stocking | 114/234 |
| 3,701,601 | 10/1972 | Plumpe et al. | 235/151.35 |
| 3,807,860 | 4/1974 | Brainard | 235/151.35 |

*Primary Examiner*—Robert B. Reeves
*Assistant Examiner*—H. Grant Skaggs
*Attorney, Agent, or Firm*—Albert L. Jeffers; Roger M. Rickert

[57] ABSTRACT

A system is provided for monitoring fluid discharged from ships and for determining the amount of contaminants, such as oil, in the fluid. The discharge from the ship is continuously monitored by a meter which will indicate the oil content of the discharge in, for example, parts per million. The indicated value may be charted for record purposes. The total volume of discharge from the ship and the speed of the ship may also be measured. The three values obtained by the foregoing measurements are processed in computing mechanism and a value is obtained for the amount of contaminants being discharged for each unit distance travelled by the ship. When the aforementioned value reaches a predetermined amount, the discharge from the ship is interrupted, or reduced, so that at no time do the amount of contaminants discharged from the ship exceed a predetermined allowable limit with respect to the speed of travel of the ship. The system is also applicable for controlling the discharge from a ship to limit the concentration of oil in the discharge without regard for the speed of the ship or the total volume of the discharge.

11 Claims, 5 Drawing Figures

METHOD AND APPARATUS FOR CONTROLLING THE DISCHARGE OF CONTAMINANTS FROM SHIPS

The present invention relates to the monitoring of contaminants discharged from a ship and the controlling of the discharge, to prevent the rate of contaminant discharge from exceeding a predetermined value.

Many ships have bilges, ballast tanks or slop tanks containing water which is contaminated with oil. The discharge of water, from such tanks into the sea, has resulted in pollution of the sea waters and deterioration of the environment.

For the reason that serious problems have been created by the discharge of contaminated or oily water from ships, rules and regulations have been established by international organizations to reduce the pollution of the navigable waters to acceptable limits.

The aforementioned rules and regulations specify, for example, the allowable discharge of oil in water in parts per million in the control areas and territorial waters, and allowable discharge of oil in liters per nautical mile on the high seas.

The rules and regulations which have been adopted differentiate between existing and new tankers. For example, the existing tankers are allowed to discharge oil of 1/15,000 of the quantity of the cargo, while new tankers are allowed to discharge 1/30,000 of the quantity of the cargo only.

The above discharge of oil is related to ballast and wash water which is generated during ballasting or cleaning of tanks on board of tankers. The subsequent discharge of water contains oil and the concentration of oil in the discharge must be maintained below the specified maximum.

In some cases, especially tankers, which are not provided with filtering systems, the regulations set a maximum rate of discharge of oil into the sea for each unit distance of travel of the ship.

With the foregoing in mind, the primary objective of the present invention is the detection and measurement of oil in water discharged from ships.

A further objective is the provision of an oil discharge monitoring and control system which can be installed on existing as well as on new ships and which will enable the ships to meet the requirements established by the regulations generally referred to above.

A further objective is the provision of a method and apparatus of the nature referred to above which is substantially completely automatic in operation.

A still further objective is the provision of a method and apparatus of the nature referred to which maintains a record at all times which will reveal the rate of discharge of oil from the ship, the distance travelled by the ship, and the total quantity of oil discharged from the ship.

A still further objective is the provision of a system of the nature referred to which will automatically control the rate of oil discharge and shut down the discharge in the event of a failure of the system or the power supply thereto.

BRIEF SUMMARY OF THE INVENTION

According to the present invention, a discharge system is provided on the ship for discharging fluid from bilge, ballast, slop tanks or from fuel or cargo tanks. The fluid being discharged from the ship is monitored continuously by a full flow instrument. In case of very large discharge flow, the fluid being discharged from the ship is continuously monitored by withdrawing a fraction thereof, and then measuring the oil content in the withdrawn fraction.

Preferably, the aforementioned sampling fraction is withdrawn from the main fluid stream by a centrifugal pump which is operable for emulsifying the withdrawn fraction prior to the measurement thereof.

The measuring device, or sensing head, which determines the oil content in the same is preferably a light operated device of a known type. In one such device, a light source is provided which projects the light through the liquid being measured to a first photocell to obtain a first value, while a second photocell is provided outside the range of the direct light from the light source so that the second photocell receives light scattered within the fluid sample by the oil particles therein. By comparing the signals from the photocells, an indication of concentration of oil in the sample, for example, in parts per million can be obtained.

A light operated detector of the general nature above described is shown in U.S. Pat. No. 3,510,666.

The withdrawn fraction can then be returned to the main fluid stream or discharged from the vessel or returned to a point upstream from the place of sampling. The fraction is continuously withdrawn, as mentioned, so that the monitoring of the oil content therein is a continuous process.

The total amount of fluid being discharged from the ship may be measured by a meter or indicator which produces a signal in conformity with the volumetric rate of fluid discharge from the ship.

Still another signal may be established in conformity with the speed at which the vessel is moving.

The signals derived from the measurement of oil concentration in the fluid and from the rate of fluid discharged, and from the rate of movement of the vessel are supplied to a computer device and the computer device, in turn, supplies a signal, the valve of which represents the total amount of contaminant discharged from the ship for each unit of distance travelled thereby, for example, liters/nautical mile.

Recording means are provided which record the total amount of contaminants discharged and also record the total travel of the ship, while there may also be prepared a chart on which the instantaneous rate of discharge of contaminant for each unit of distance travelled by the ship is indicated. The recording and indicating apparatus can also include an arrangement for printing out a record which can be submitted to the proper authorities as a proof of contaminant levels discharged, the amount discharged and the duration of discharge.

In another application of the present invention, the speed of the ship is not monitored and, instead, the discharge from the ship is controlled only in respect of the oil content therein, which can be in parts per million.

The system of the present invention may provide for regulating the discharge from the ship when the oil concentration in the discharge, or the rate of oil discharge from the ship, exceeds allowable limits.

Some ships, especially smaller ships, are provided with filtering systems for separating oil and contaminants from bilge water and other waters, such as cleaning waters, that may be discharged from the ship. In this case, it is proposed that the discharge from the ship be monitored so that the concentration of contaminants in the fluid can be detected, measured and recorded while the discharge from the ship can be interrupted or the rate thereof reduced if the contamination level exceeds a predetermined maximum amount.

With other ships, particularly with large ships, especially tankers, such filtering systems are not usually provided because the major problem encountered is that of disposing of oil residues from the cargo tanks and the like.

When a vessel of this nature puts to sea after unloading a cargo, not only are ballast tanks provided for receiving ballast water but, usually, water must also be drawn into the cargo tanks so that the ship is properly maneuverable in a safe condition for returning for a further cargo of oil. The ship must remain ballasted until it reaches the port in which it is to receive cargo and if the ballasting water from the cargo tanks is then discharged into the port, a most objectionable condition is created. Thus, such ships normally clean the cargo tanks en route and discharge the dirty cleaning fluid into the open sea. This has, also, proved to be objectionable because the sea becomes contaminated with the oil.

More recently, a system has been developed in which contamination of the sea is reduced while up to about 99 percent of the residual oil remaining in the fuel tanks is recovered. In this system, the cargo tanks are flushed out and the flushing fluid is supplied to a first slop tank in which there is a primary separation of oil from water. The water is drawn from the bottom of the first slop tank and delivered to a second slop tank wherein further separation of oil from the water takes place while water from the bottom of the second tank is utilized for flushing out the cargo tanks.

After the cleaning of the cargo tanks is completed, water is withdrawn from the bottom of the second slop tank and discharged to the sea. It is this water which must be maintained within predetermined limits with respect to oil contamination while, further, it is important that the oil be discharged from the ship at no greater than a predetermined quantity per nautical mile as above described. The oil separated out in the slop tanks is then returned to the cargo tanks and the new cargo is loaded on top of the recovered residue. In this manner, the discharge from the ship can be maintained within presently acceptable limits.

In each of the aforementioned cases, the discharge is continuously monitored and a record is maintained of the contamination level of the fluid discharged, with suitable controls being provided, if desired, for interrupting the discharge when the contamination level exceeds a predetermined amount, or for reducing the rate of discharge if the oil discharge per unit distance travelled by the ship exceeds a predetermined amount.

The exact nature of the present invention and the operation thereof will become more apparent upon reference to the following detailed specification taken in connection with the accompanying drawings in which:

FIG. 1 schematically shows a system according to the present invention.

FIG. 2 schematically shows the oil meter of the system.

FIG. 3 schematically shows the computing device of the system.

FIG. 4 schematically shows the indicating chart device of the system.

FIG. 5 schematically illustrates an installation wherein cargo tanks are arranged for being cleaned with the cleaning water being processed to remove oil therefrom and then monitored by a system according to the present invention prior to discharge from the ship.

DETAILED DESCRIPTION OF THE INVENTION

Figure 1:
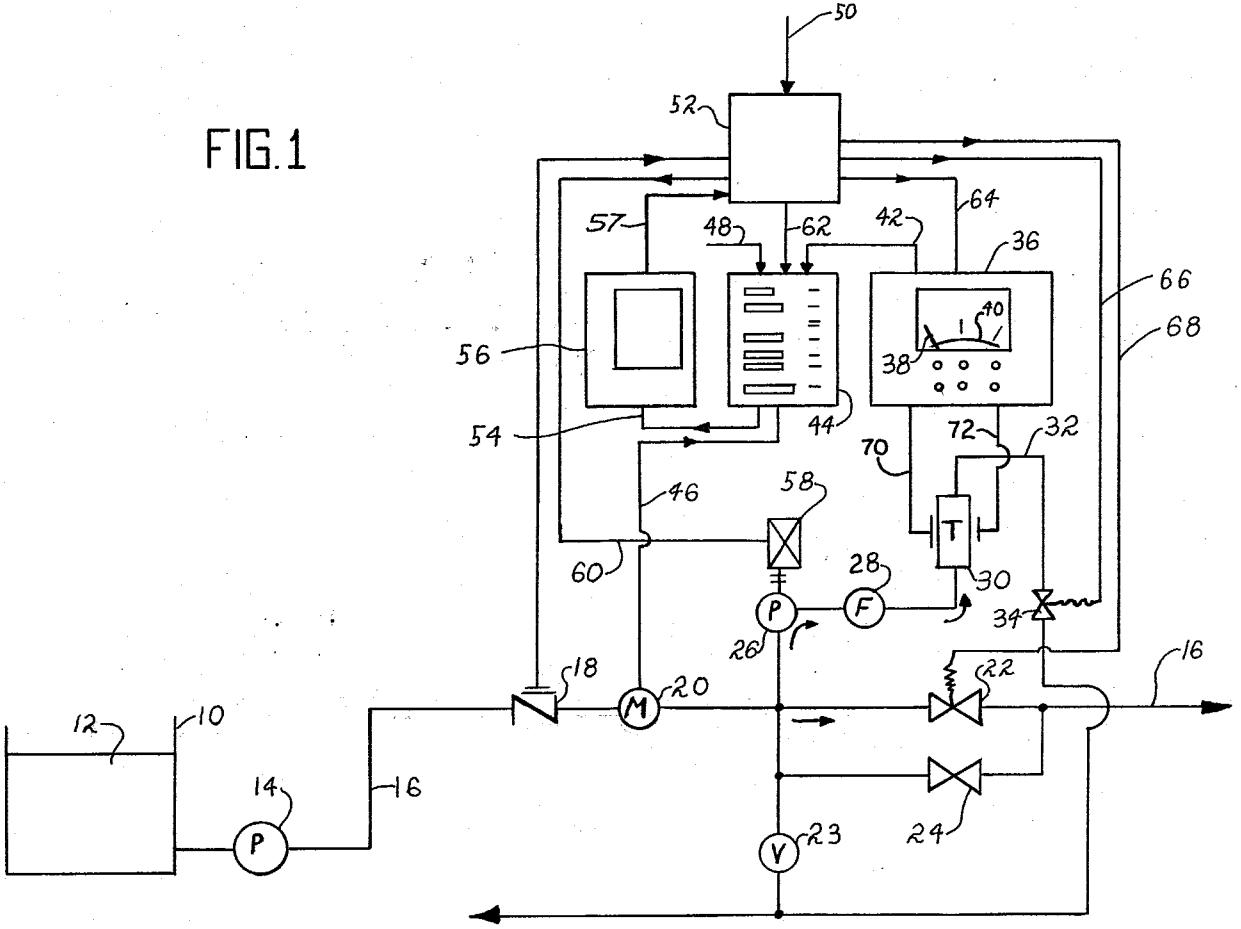

Referring to the drawings in FIG. 1 somewhat more in detail, reference numeral 10 indicates a tank such as a bilge or ballast tank or any other tank which contains fluid 12 such as oily water. Where the fluid is clear or uncontaminated water, discharge of the fluid from the vessel can be made at any time. However, since such fluids are often contaminated, expecially with oil, and discharge of this type of fluid from the ship must meet the requirements that have been established through generally accepted rules and regulations, such fluids must, accordingly, be treated, or the rate of discharge from the ship must be regulated.

The system of the present invention for regulating the discharge from the ship comprises a pump 14 which is connected to withdraw fluid from tank 10 and may be controlled in any suitable manner, either manually or automatically. Such pumping arrrangements are known and are quite often arranged to operate in conformity with the liquid level or the oil-water interface in tank 10. Pump 14 discharges fluid into a conduit 16 and within the conduit is a flow sensing element 18 followed by a flow meter 20 and which, in turn, is followed by a control valve 22. Conduit 16, downstream from control valve 22, leads to a point of discharge of the fluid from the ship.

The valve 22 is preferably bypassed by a manual valve 24 so that under conditions of 'emergency only', valve 24 can be operated to permit discharge of fluid from tank 10. Under all normal operating conditions, however, valve 24 remains closed and all of the fluid discharged from tank 10 passes through valve 22.

In conformity with the present invention, means are provided for continuously sampling the fluid in conduit 16. This takes the form of the centrifugal pump 26 having its inlet connected to conduit 16 as by a pitot tube, for example, and having its discharge side connected through a filter 28 to the inlet of a detector 30. Normally, a few gallons per minute only are taken for sampling.

Pump 26, as mentioned, is a centrifugal pump and thoroughly emulsifies the water and oil which it withdraws from conduit 16. Filter 28 removes solid particulate material from the fluid while permitting the oil to pass with the withdrawn sample of fluid to the inlet of detector 30. In some cases the filter 28 can be omitted and the pump discharge can be connected directly to the detector 30.

The discharge from detector 30 can be connected to conduit 16 for discharge to sea or conveyed back to tank 10 by way of conduit 32 and within which is a control valve 34 which is open when the system is operating. Should the predetermined contaminant level be exceeded, the system discharge valve 22 with throttle, or close, sending the contaminated water through relief valve 23 back to tank 10.

The detector 30, which is of a known type, sends signals to oil meter 36, where the signal is displayed on an indicator or meter. Oil meter 36 may be graduated in parts per million and the indication given thereby will represent the parts per million of contaminant.

especially oil, in the fluid passing through detector 30. Other detectors may, of course, be used.

The oil meter 36 supplies a first signal, in conformity with the meter indication, via wire 42 to a computer 44 with the said first signal representing the parts per million of contaminant in the fluid passing through detector 30. This first signal may be employed directly for controlling the discharge from the ship or for actuating a recorder 56 to maintain a record of the degree of contamination of the discharged water.

Flow meter 20 supplies a second signal via wire 46 to computer 44, with this second signal representing the volume of fluid passing through conduit 16 in a given time period, for example, gallons or liters per minute.

The signals from the oil meter 36 and the flow meter 20 may be employed together to give the value of total oil discharged and which values may also be charted.

Still another signal can be supplied to computer 44 via the wire 48 representing the speed of the vessel, for example, in knots.

The computer 44 is supplied with energy from a power supply line 50 which passes through a power control unit 52. The computing mechanism at 44 has a plurality of functions, including which is the supply of a signal by wire 54 to a recorder 56 and which recorder records the instantaneous value of the quantity of contaminant discharged from the vessel for each unit of distance, for example, a nautical mile, that the ship travels. The recorder advantageously draws a line on a chart so that a continuous instantaneous indication is provided of the rate at which contaminants are discharged from the vessel for each unit of distance travelled by the vessel.

The power control unit 52 is under the control of a signal supplied by the flow sensing unit, or device, 18 in conduit 16 so that when pump 14 is started and fluid commences to flow in conduit 16, flow sensing device 18 will be actuated and supply a signal to the power control unit 52 which places the system in operation.

As soon as the power control unit is actuated, the drive motor 58 for pump 26 is energized via line 60 and pump 26 commences to sample the fluid flowing in conduit 16. The power control unit, as mentioned, supplies an actuating signal to computer 44 by line 62 and, likewise, actuates the oil meter 36 through line 64.

Still further, energy supplied from power control unit 52 via line 66 effects opening of valve 34. The power control unit 52 also supplies energy via line 68 to main flow control valve 22 to effect opening of this valve.

Thus, immediately upon energizing motor 14 and causing flow in conduit 16, the entire system goes into operation and the fluid discharged from the ship is continuously monitored thereby.

Should the amount of contaminant in the fluid being discharged exceed the desired amount, the power supplied to valve 22 will be reduced, valve 22 will partially close, reducing the flow, or completely close, and interrupt the discharge of fluid from the ship. The fluid from conduit 16 will be redirected through the relief valve 23 back to the tank 10. Similarly, valve 22 will close upon failure of any component within the system so that, upon repair or resetting of the failed component, the system can be placed back in operation and discharging of fluid can then be resumed.

Valve 22 has been illustrated as a normally closed valve which is opened when energy is supplied thereto by line 68. However, it will be apparent that valve 22 could be a valve which can be adjusted and in which case the supply of energy to the valve would be varied in conformity with the rate of discharge of contaminants from the ship so that the rate of contaminant discharge would fall within predetermined acceptable limits. Such a variable flow control valve is contemplated within the purview of the present invention.

Figure 2:
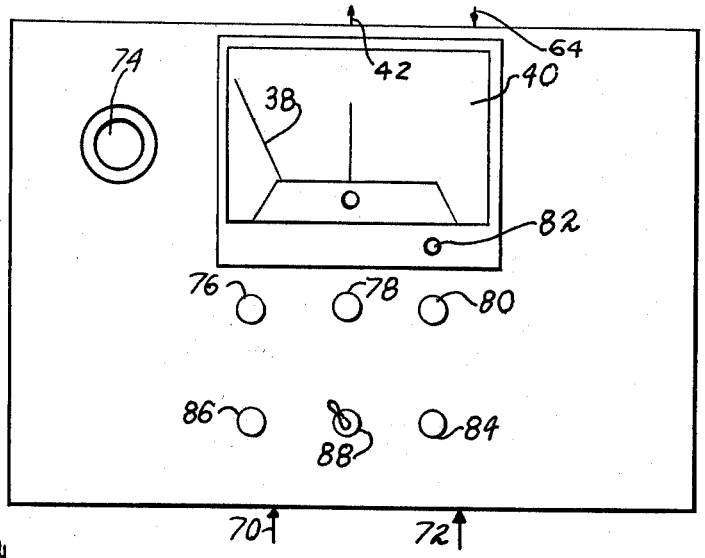

FIG. 2 shows more in detail the oil meter 36. FIG. 2 shows the wires 70 and 72 that lead from the detector 30 to the meter and form the inputs thereof, and also shows the line 64 leading from the power control unit 52 which supplies energy to the oil meter. FIG. 2 also shows the wire 42 from which the signal representative of the parts per million or other measurement units of contaminant in the fluid being discharged is supplied to the computer device 44.

The oil meter 36 will be seen to comprise an alarm device 74 which preferably supplies an audible signal when the measurement unit of contaminants in the fluid being discharged exceeds a predetermined amount. The meter may include an indicator 76 which is illuminated when the contaminants are at a level below a predetermined amount, as indicator 78 which becomes illuminated when the contaminant level rises to an intermediate range, and an indicator 80 which becomes illuminated when the contaminant level reaches a high range.

The instrument also comprises an adjustable element 82 which can be adjusted to change the preselected level of concentration of contaminants in the liquid being discharged. The instrument also comprises automatic calibration means and an instrument calibration adjustment 86, a calibration indicator at 84 and a selector at 88 which can be used to select the range of operation of the instrument.

Figure 3:
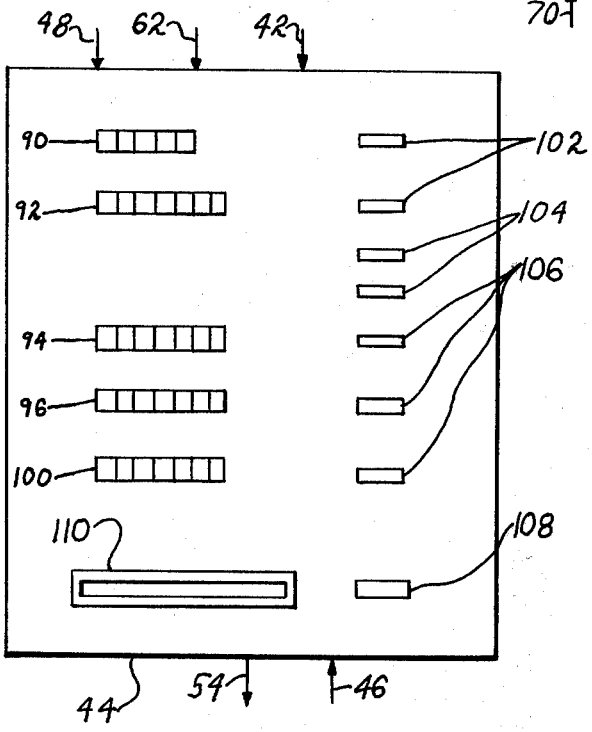

The computing device, or mechanism, 44 is shown in FIG. 3. FIG. 3 shows the input line 46 from which the meter signal representing the rate of discharge of effluent is supplied to the computer and also shows the wire 42 leading from the oil meter. The power supply line is indicated at 62 and the line 48 is also illustrated which supplies the signal to the computing device representative of the speed of the vessel.

The computing device may include a presettable indicator at 90 for indicating the voyage number and a presettable indicator at 92 for indicating the amount of the cargo and a further indicator at 94 which automatically indicates the allowable oil discharge during the contemplated voyage, for example, in liters.

Furthermore, the computer includes indicating means at 96 which registers the total discharge of contaminants from the ship at any time. A still further indicator at 100 indicates the total nautical miles covered by the ship at any time.

The computer, furthermore, comprises reset and lock control means 102. The computing mechanism at 44 also includes selector means 104 for adjustment of the computer between operation for existing ships and operation for new ships.

Reset and zero controls are indicated at 106 in FIG. 3 and a control 108 is provided for controlling the print-out. The computer mechanism includes a print-out at 110 and when the control 108 is actuated, a print-out will be given on which the voyage number is shown, the date and time, the preset cargo amount shown, the allowable oil discharge shown, the accumulative total in nautical miles, and the accumulative total of oil discharge in liters shown. By submitting the print-out, together with the chart from the recorder, at the place of destination, it can readily be determined by the authorities whether or not the ship was operating in accordance with the rules and regulations during the voyage.

The computation performed by the computer is as follows:

$V/S \times C = R$, where V is the rate of fluid discharge from the ship in liters/hour; S is the speed of the ship in knots (nautical miles/hour); C is the amount of contaminant in the fluid in parts per million; and R is the liters of oil discharge per nautical mile.

Figure 4:
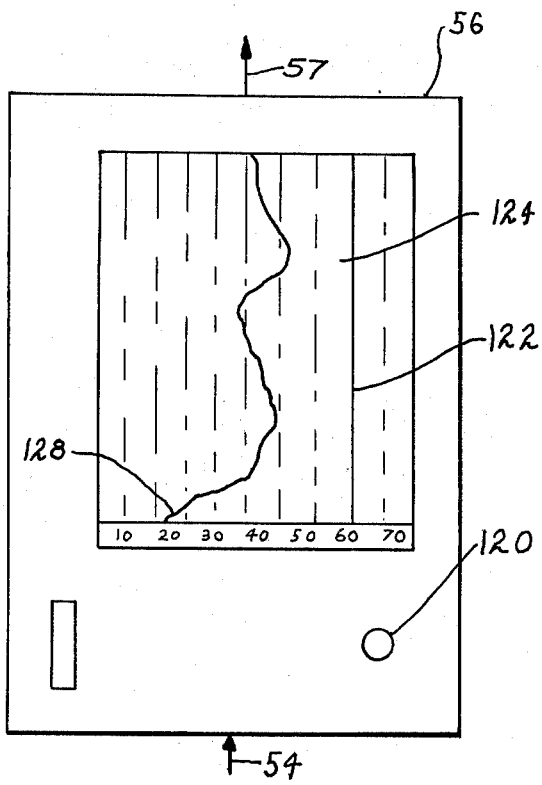

FIG. 4 is a schematic view of the recorder 56 and shows the connection of line 54 which provides the signal input of oil per nautical miles from computer. The recorder comprises an adjustment at 120 for adjusting the permissible contamination level. This adjustable contamination level is indicated at 122 and may consist of an indicator and an actuating device which will limit via line 57 and power control 52 the amount of contaminant discharge by control of valve 22 in FIG. 1. The position of the indicator is shown at 122 and a record can be shown by a line drawn on the chart 124.

The recorder comprising an inscribing pen draws a line 128 on the chart which shows the quantity of contaminants discharged for each unit of distance travelled by the ship, for example, the chart may be graduated in liters per nautical mile.

In general, the instantaneous rate of discharge of oil content from a ship must not exceed 60 liters per nautical mile and must also not exceed in totality a certain ratio with respect to the cargo quantity carried by the respective ship.

A satisfactory oil discharge monitoring and control system meets the following specifications:

a. The system shall come to operation when there is any discharge of effluent into the sea.

b. The system shall ensure that any discharge of oily mixture is automatically stopped when the instantaneous rate of discharge of oil exceeds the allowable level.

c. Any failure of the system shall stop the discharge.

d. A manually operated alternative method shall be provided and may be used in the event of such failure.

Figure 5:
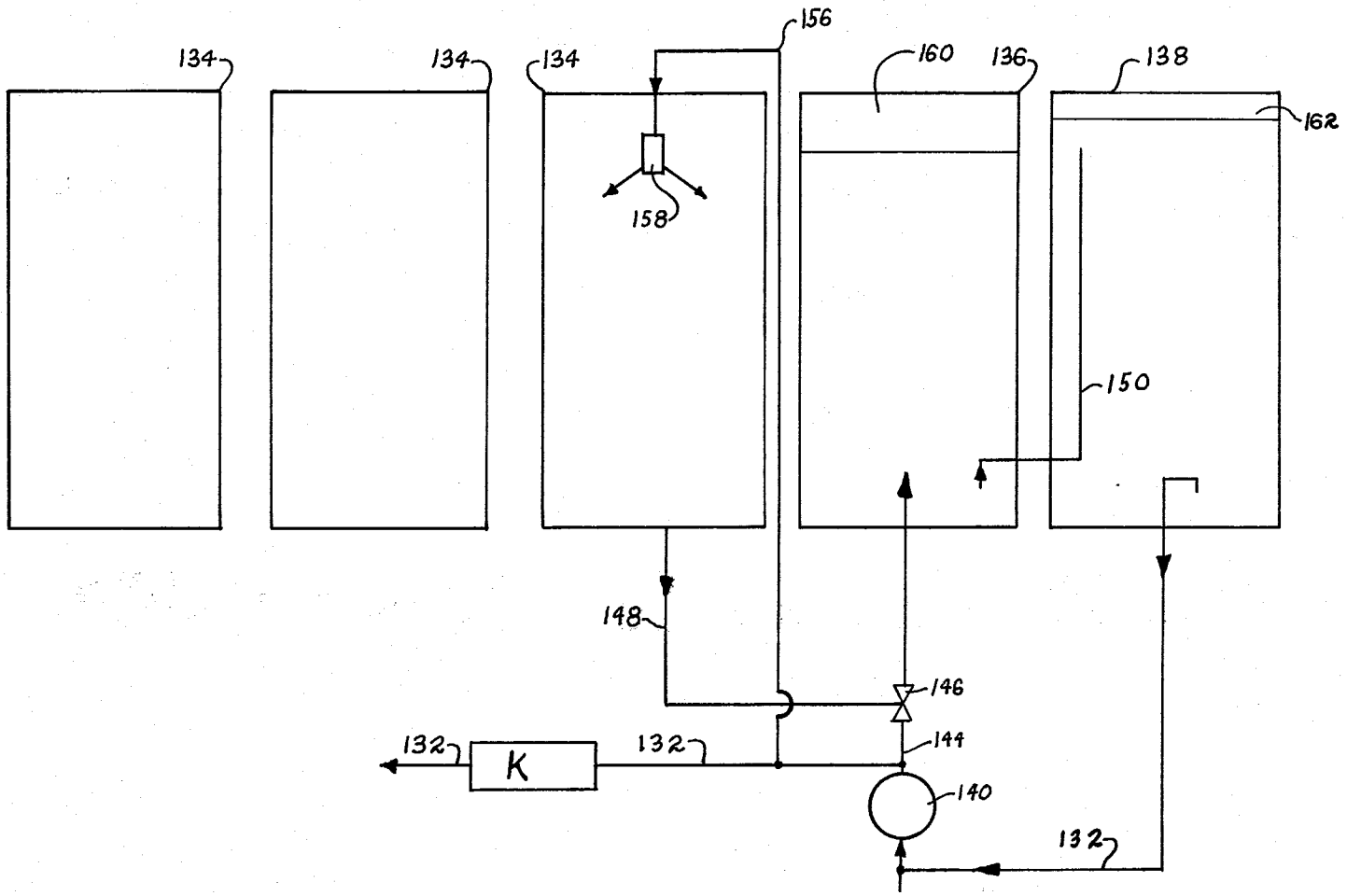

FIG. 5 schematically illustrates how the present invention can be incorporated in a large vessel, for example, a large tanker or the like. In FIG. 5, the pump 140 corresponds to pump 14 of FIG. 1 and conduit 132 corresponds to conduit 16 of FIG. 1. The monitoring system of FIG. 1 which is supplied on the left side by conduit 16 and from which the discharge conduit, also numbered 16, exits from the right is indicated by the rectangle marked K in FIG. 5.

FIG. 5 illustrates at 134 cargo tanks in which crude oil may be transported. Reference numeral 136 indicates a dirty slop tank and reference numeral 138 represents a clean slop tank.

A pump 140 is connected by conduit 132 to draw water from the clean slop tank 138 and supplies this water via conduit 144 to the bottom of dirty slop tank 136. Conduit 144 contains a device creating suction, much as venturi arrangement at 146, the suction port which is connected by conduit 148 to the bottom of a tank 134. Only one of the tanks 134 is shown connected in the circuit, but it will be understood that by suitable valving and the like each of the tanks could be put in the circuit in succession and all thereof treated.

A lower region of dirty slop tank 136 is connected by conduit 150 with an upper region of the secondary slop tank 138, the lower end of which, as mentioned, communicates with conduit 132.

The discharge side of pump 140 is also connected by conduit 156 with a spray head 158 advantageously disposed in an upper region of tank 134.

When a tank 134 is to be cleaned, pump 140 supplies water from a lower region of clean slop tank 138 under a high pressure to spray head 158 and the water, which may be heated, will scour tank 134.

The water withdrawn from tank 138 is made up by water flow thereto from tank 136 and this water is, in turn, made up by withdrawing water from the lower region of the tank 134 which is being cleaned. The oil-water mixture supplied to tank 136 is more or less emulsified and will, upon dwelling in tank 136, undergo separation so that most of the oil will accumulate in the upper end of tank 136 as indicated at 160.

Similarly, oil in the water which passes over from tank 136 to tank 138 separates from the water and moves to the top of tank 138 as indicated at 162.

Upon aforementioned cleaning of tanks 134, the water from the bottom of clean slop tank 138 can be discharged, and the oil content of which is monitored by the system marked K and which, it will be understood, is that system which is illustrated in detail in FIG. 1 of the drawings.

It will be evident that the cleaning of tanks 134 can proceed en route and only substantially clean water needs to be discharged from tank 138 and also any water that may be contained within tanks 134 for ballast purposes is also clean enough to be discharged.

The oil which accumulates in tanks 136 and 138 is returned to one or more of tanks 134 prior to taking on a new cargo. This can be accomplished by withdrawing the oil from the upper ends of tanks 136 and 138.

In the aforesaid manner, the objectionable discharge of oil from the ship is regulated so that the discharge of pollutants into the sea is maintained within acceptable limits.

What is claimed is:

1. In a system for controlling the discharge of contaminated fluid, such as ballast, or slop water, from a ship; monitoring means operable for continuously checking the fluid for the contamination level thereof and operable to develop a first signal in conformity with the contamination level of the fluid, second signal developing means operable to develop a second signal in conformity with the speed of the ship, flow meter operated means through which the fluid discharged flows operable to develop a third signal in conformity with the rate of said discharge, computer means connected to receive said first, second and third signals and operable to develop a control signal in conformity with the rate of contaminant discharge per unit of distance travelled by the ship, and control means connected to receive said control signal and operable to control the discharge of fluid from the ship in conformity with said control signal.

2. A system according to claim 1 which includes recorder means operated by said control signal for recording the rate of contaminant discharge from the ship relative to the speed of the ship.

3. A system according to claim 1 which includes valve means operated by said control means for slowing down, reducing or shutting off the discharge of fluid from the ship whenever the rate of contaminant discharge from the ship relative to the speed of the ship exceeds a predetermined value.

4. A system according to claim 3 which includes a manual bypass valve connected by conduits in parallel with said valve means.

5. A system according to claim 1 in which said control means includes means sensitive to the initiation of fluid discharge from the ship for making said system effective.

6. A system according to claim 1 in which said monitoring means includes a pump connected to withdraw a fraction of the fluid being discharged from the ship, said pump emulsifying the withdrawn fluid, and a contaminant sensing head connected to the dischrge side of the pump to receive said withdrawn fluid therefrom and operable to develop said first signal.

7. A system according to claim 1 in which said computer means includes integrating means and put out means connected thereto operable for maintaining a record of total contaminant discharge from the ship and the total distance travelled by the ship.

8. A method of controlling the rate of discharge of contaminants from a ship during the discharge of contaminated fluid therefrom which comprises; measuring the contaminants per unit volume of the fluid discharged from the ship, measuring the volumetric rate of discharge of contaminated fluid from the ship, measuring the speed of travel of the ship, processing the values obtained from the said measurements to obtain a value representative of the amount of contaminant discharged from the ship for each unit of distance travelled by the ship, and controlling the discharge from the ship to maintain said value below a predetermined amount.

9. The method according to claim 8 which includes continuously recording said value.

10. The method according to claim 8 which includes continuously summing the volume of contaminant discharged from the ship and also summing the distance travelled by the ship.

11. The method according to claim 8 in which the measurement of the amount of contaminants in the fluid being discharged is effected by continuously withdrawing at least a fraction of the fluid being discharged, filtering and emulsifying the withdrawn fraction, and passing the emulsified fraction through a contaminant detecting and measuring head.

* * * * *

UNITED STATES PATENT OFFICE

CERTIFICATE OF CORRECTION

Patent No. 3,974,940 Dated August 17, 1976

Inventor(s) Ivan Bartik

It is certified that error appears in the above-identified patent and that said Letters Patent are hereby corrected as shown below:

Column 2, line 39, "valve" should read ---value---.

Column 4, line 61, "with" should read ---will---.

Column 6, line 22, "as" should read ---an---.

Column 9, line 14, "dischrge" should read ---discharge---.

Column 9, line 18, "put out" should read ---print out---.

Signed and Sealed this

Nineteenth Day of October 1976

[SEAL]

*Attest:*

RUTH C. MASON
*Attesting Officer*

C. MARSHALL DANN
*Commissioner of Patents and Trademarks*

UNITED STATES PATENT AND TRADEMARK OFFICE

CERTIFICATE OF CORRECTION

PATENT NO. : 3,974,940

DATED : August 17, 1976

INVENTOR(S) : Ivan Bartik

It is certified that error appears in the above-identified patent and that said Letters Patent are hereby corrected as shown below:

Title Page: Assignee: Keene Corporation, New York, N.Y.

Signed and Sealed this

Fourteenth Day of December 1976

[SEAL]

*Attest:*

RUTH C. MASON
*Attesting Officer*

C. MARSHALL DANN
*Commissioner of Patents and Trademarks*